US005103133A

United States Patent [19]

Misono

[11] Patent Number: 5,103,133

[45] Date of Patent: Apr. 7, 1992

[54] FLUORESCENT LAMP HAVING LOW CATHODE FALL VOLTAGE

[75] Inventor: Katsuhide Misono, Yokohama, Japan

[73] Assignee: Toshiba Lighting & Technology Corporation, Tokyo, Japan

[21] Appl. No.: 660,257

[22] Filed: Feb. 26, 1991

Related U.S. Application Data

[63] Continuation of Ser. No. 372,455, Jun. 28, 1989, abandoned.

[30] Foreign Application Priority Data

Jun. 30, 1988 [JP] Japan ..... 63-163280
Jan. 30, 1989 [JP] Japan ..... 1-20558

[51] Int. Cl.[5] ..... H01J 61/12
[52] U.S. Cl. ..... 313/491; 313/573
[58] Field of Search ..... 313/484, 491, 493, 573

[56] References Cited

FOREIGN PATENT DOCUMENTS 60-1744 7/1985 Japan ..... 313/484

OTHER PUBLICATIONS

Journal of the Illuminating Engineering Institute of Japan, "The Starting Energy of the Discharge Lamps and the Design Criteria of the Ballasts," vol. 57, No. 9 (1973), Akihiro Inoue, pp. 12–21.

Journal of the Illuminating Engineering Society, "The Glow-to-Thermionic-Arc Transition," vol. 16, No. 2, Summer (1987), John F. Waymouth, pp. 166–180.

Thomas F. Soules et al., "Thermal Model of the Fluorescent Lamp Electrode," Feb. 5, 1988, *IES*, pp. 1–18, 15 drawing pages.

Waymouth, *Electric Discharge Lamps*, p. 71, ©1971 by MIT.

*Primary Examiner*—Sandra L. O'Shea

*Attorney, Agent, or Firm*—Oblon, Spivak, McClelland, Maier & Neustadt

[57] ABSTRACT

A fluorescent lamp of a hot cathode type which is operated with a lamp current of 50 mA or less comprises an outer tube as an envelop, a gas filled in the envelop and a pair of electrodes disposed at both ends of the outer tube in an opposing fashion, at least one of the electrodes being operated in a hot cathode mode. With the fluorescent lamp of the type described, a following relationship is established, $p.d \geqq 13$, where d represents an inner diameter (cm) of the envelop and p represents an inner pressure (Torr) of the gas filled in the envelop. When the relationship $V_k \leqq 15$, where $V_k$ represents a cathode fall voltage, is further satisfied, the life time of the fluorescent lamp can be elongated.

4 Claims, 7 Drawing Sheets

FLUORESCENT LAMP HAVING LOW CATHODE FALL VOLTAGE

This application is a Continuation of application Ser. No. 07/372,455, filed on Jun. 28, 1989, now abandoned.

BACKGROUND OF THE INVENTION

The present invention relates to a small fluorescent lamp which is operated with a lamp current of 50 mA or less, and enables rapid transition from glow discharge to arc discharge at starting, as well as stably maintains arc discharge during long lighting operation period.

Fluorescent lamps are generally used as high-efficiency light sources for lighting in a wide range, this being greatly attributed to the provision of a hot cathode. Specifically, this is because the use of a hot cathode enables a reduction in the lamp voltage and thus permits easy lighting with a voltage of 100 to 200 V. It is also important that the employment of a hot cathode causes a reduction in the descent loss and thus an improvement of the luminous efficacy of a lamp.

Now, fluorescent lamps are employed for general lighting as well as office equipment (OA equipment), and small fluorescent lamps are used as back lights for liquid crystal televisions and so on. Such liquid crystal televisions are, however, mainly of a portable type which can be driven by a dry battery for the purpose of making the best use of their small size and light weight. In this case, since the electric power consumed by a back light is preferably small, a fluoroscent lamp of a hot-cathode type is used and so designed as to be lighted with a lamp current of 10 to 30 mA.

Discharge forms of fluorescent lamps include cold cathode glow discharge and hot cathode discharge. The former has a long life but exhibits a large degree of cathode fall and a poor luminous efficiency. The latter has a life shorter than that of the cold cathode, but exhibits a small cathode fall and a good luminous efficiency. Since a battery device is employed in a portable liquid crystal television in view of its portability, it is desirable that the electric power consumed by the back light be as small as possible. Hot cathode-type fluorescent lamps are therefore attractive. Nevertheless, the hot cathode-type fluorescent lamps have not been put into practical use because of problems with respect to their useful operational life. This is described in detail in, for example, the report on hot cathode-type fluorescent lamps used for back lights in the paper (March, 1988) of the Illuminating Engineering Institute of Japan; the Committee of Research and Development of Display Materials and Devices.

However, the temperature of the cathode luminescent point is set at a point at which the heat losses caused by radiation and conduction are well balanced in the heating function effected by the ion current which flows during the cathode cycle and the electron current which flows during the anode cycle. The thermionic current required for maintaining the arc discharge and the radiation loss which causes a decrease in the temperature of the luminescent point depend upon the size and the temperature of the cathode luminescent point. When the same level of thermionic current is obtained, however, the radiation loss can be kept at a low level by reducing the size of the luminescent point and increasing the temperature thereof. That is, it is possible to efficiently heat the electrode by increasing the temperature of the luminescent point and reducing the size thereof. It is therefore effective to reduce the diameter of a filament wire which forms the hot cathode with a reduction in the lamp current.

From this reason, the diameter of the coil wire is substantially determined to a given value relative to the lamp current when a hot cathode used for a fluorescent lamp is designed by conventional methods. The use of a coil with the diameter calculated on the basis of the design standards enables the temperature of the cathode luminescent point can be kept at a value within the range of 1000° to 1050° C.

When a coil used for the hot cathode of a fluorescent lamp with a lamp current of 50 mA or less is designed using the above-described standards, the diameter of the coil becomes a negative value at a lamp current of about 50 to 70 mA, if the diameter of a tungsten coil with a lamp current of 50 mA or less is extrapolated using the conventional design standards, as shown in FIG. 8. The diameter is actually 1 MG or less because as small a value as possible is selected. The unit MG is a unit used for indicating the diameter of metal wires and represents a value in terms of mg of the weight of a metal fine wire relative to a length of 200 mm.

Since such a fine tungsten wire is not easily produced or processed and the obtained coil has a low level of mechanical strength, close attention must be paid to handling. In addition, since an increase in the size creates a danger of deformation due to the dead weight of the coil, the size cannot easily be increased. It is therefore impossible to deposit a satisfactory amount of emitter, and it is difficult to increase the absolute operational life of the electrode.

However, if a coil is designed by using a thick tungsten wire which deviates from the above-described design standards, since the hot cathode obtained has a large cathode luminescent point, the necessary high temperature of the luminescent point cannot be obtained. Thus, a satisfactory thermionic current cannot be obtained in some cases, and transition from glow discharge to arc discharge does not smoothly take place at starting. Alternatively, the arc discharge is unstable and in some cases reverses to the glow discharge or goes out. In the extreme case, transition to the arc discharge does not take place at starting and the glow discharge continues for a long time. When a lamp frequently comes on and off or when the time taken for glow discharge is long, a large amount of the emitter scatters, sometimes resulting in a reduction in the life owing to early blackening or early wear or the occurrence of early breaking of the coil.

Furthermore, with a small hot cathode-type fluorescent lamp with a small lamp current of about 10 mA, it is particularly desired to maintain good starting characteristics, for a long period of time and the elongated, useful operational life time of the fluorescent lamp.

SUMMARY OF THE INVENTIONS

Accordingly, it is an object of the present invention to improve a small hot cathode-type fluorescent lamp with a lamp current of 50 mA or less so that it is rapidly started and stably operated even by a low current.

Another object of the present invention is to provide a hot cathode type fluorescent lamp with a small lamp current which exhibits good starting characteristics for a long period of time from an early state of lighting to the end of the useful operational life of the lamp, and a low level of blackening of the tube wall, as well as a long life.

These and other objects can be achieved according to the present invention, by providing a fluorescent lamp of a hot cathode type which is operated with a lamp current of 50 mA or less and characterized in that a following relationship is satisfied:

$$d.p \geqq 13$$

where d represents an inner diameter (cm) of an outer tube functioning as an envelop of the fluorescent lamp and p represents an inner pressure (Torr) of a gas filled in the outer tube of the fluorescent lamp.

In a preferred embodiment, the operational life time of the fluorescent lamp can be remarkably elongated by satisfying the relationship $V_K \leqq 15$, where $V_K$ represents a cathode fall voltage in addition to the relationship $p.d \geqq 13$.

In a further aspect of the present invention, these and other objects can be also achieved by providing a fluorescent lamp of a hot cathode type which is operated with a lamp current of 50 mA or less, characterized in that following relationships are satisfied:

$$p.d < 13;$$

$$V_K \leqq 15; \text{ and}$$

$$(V_K - 10)p.d \geqq 7$$

where d represents an inner diameter (cm) of an outer tube as an envelop of the fluorescent lamp, p represents an inner pressure (Torr) of the outer tube of the fluorescent lamp, and $V_K$ represents a cathode fall voltage.

As described above, the fluorescent lamp of the present invention is a hot cathode type which is operated with a lamp current of 50 mA or less and has stable arc discharge. According to one embodiment, if the pressure of the gas filled is p Torr and the internal diameter of the tube is d cm, the relationship of $pd \geqq 13$ is established so that necessary thermionic emmision can be obtained by sufficiently increasing the temperature of the cathode luminescent point regardless of the diameter of the coil fine wire used for forming the hot cathode, resulting in easy transition to arc discharged, stabilization of arc discharge, removal of unstable lighting, a reduction in blackening at the end of the tube, a reduction in breaking of the coil, as well as prevention of a short operational life owing to an insufficient amount of emitter. According to a further embodiment, in addition to the above-described condition, the coil of the hot cathode is formed by using a fine wire with thickness of 2 MG so that the mechanical strength of the fine wire can be increased, and the production of the fine wire and formation of the coil and the hot cathode can be easily performed.

In addition, when the following relationships are satisfied;

$$pd \geqq 13 \text{ (Torr cm) and}$$

$$V_K \leqq 15 \text{ (V)},$$

the lamp exhibits good starting characteristics after being lighted for a long time, stable discharge and a reduced level of blackening on the tube wall, as well as a long life.

Furthermore, in another aspect, when the following relationships are satisfied, substantially the same effects as described above can be also attained;

$$p.d < 13 \text{ (Torr.cm)}$$

$$V_K \leqq 15 \text{ (V) and}$$

$$(V_K - 10)p.d \geqq 7$$

The preferred embodiments will be described further in detail with reference to the accompanying drawings.

DESCRIPTION OF THE PREFERRED EMBODIMENTS

For a better understanding of the embodiments of the present invention, a structure of a hot cathode type fluorescent lamp to which the present invention is applicable is first described with reference to FIG. 13.

Figure 13:
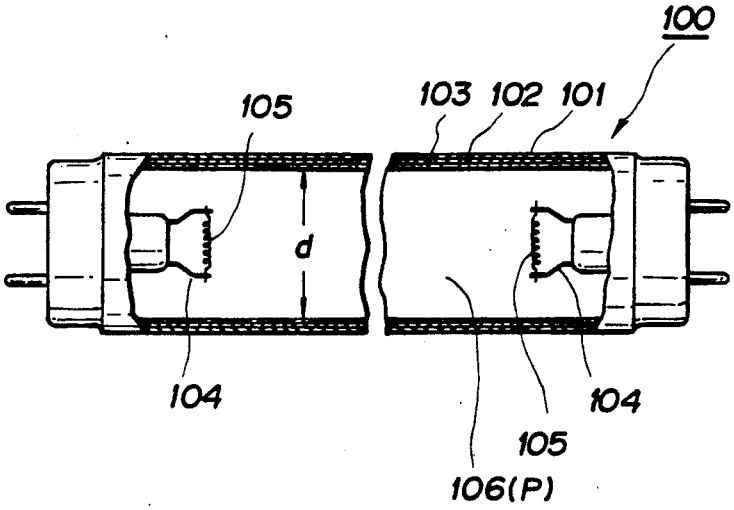
FIG. 13 shows a longitudinal section of a fluorescent lamp to which the embodiment of the present invention is applicable.

Referring to FIG. 13, a fluorescent lamp at 100 comprises an outer glass tube 101 as an envelop, the glass tube 101 being circular in cross section and having an inner diameter of d cm as well as an inner wall on which a fluorescent layer 103 are laminated. A pair of electrodes 104, including coils 105 made of fine wires, are disposed at both ends of the glass tube 101 and at least one of the electrodes is operated in a hot cathode mode. A gas 106, preferably a rare gas such as argon, is sealed in the envelope 101 for sustaining a discharge therein.

With respect to an embodiment of a fluorescent lamp having, for example, a structure shown in FIG. 13, the inventor had examined the correlation between the pressure p of the gas filled 101 and the tube diameter d and the lighting state of the lamp 100 with changing the values of p and d. A description of the embodiment of a fluorescent lamp is given below. The internal diameter d of the tube 101 of the lamp 100 was changed to various values of 3 to 7 mm, and the pressure of argon gas filled in the tube 101 was changed to various values of 5 to 50 Torr. A double coil which was formed of a 3.7 MG tungsten fine wire and on which an emitter, comprising an oxide composed of three components of barium, calcium and strontium, was deposited was used as a cathode. The lighting method employed was a method in which the lamp was directly started by applying a high-frequency voltage of 33 kHz between two electrodes without preheating.

Figure 1:
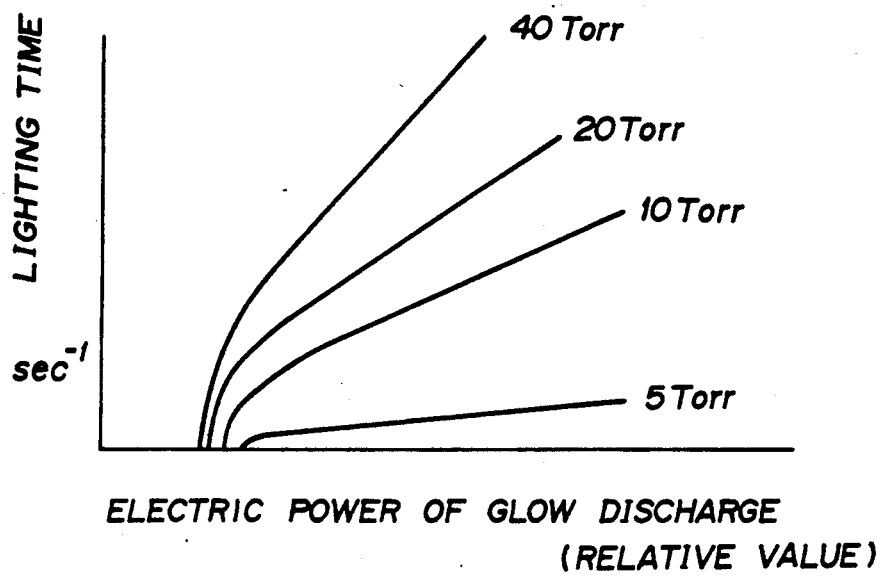
FIGS. 1 and 2 are graphs which show the relationships between the pressure of the gas fiiled and the starting characteristics when the internal diameter of the tube is fixed.
Figure 2:
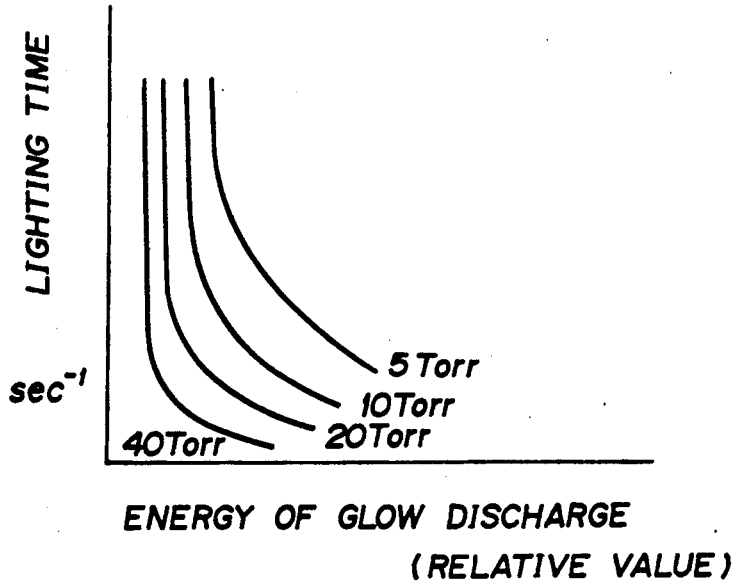
Figure 3:
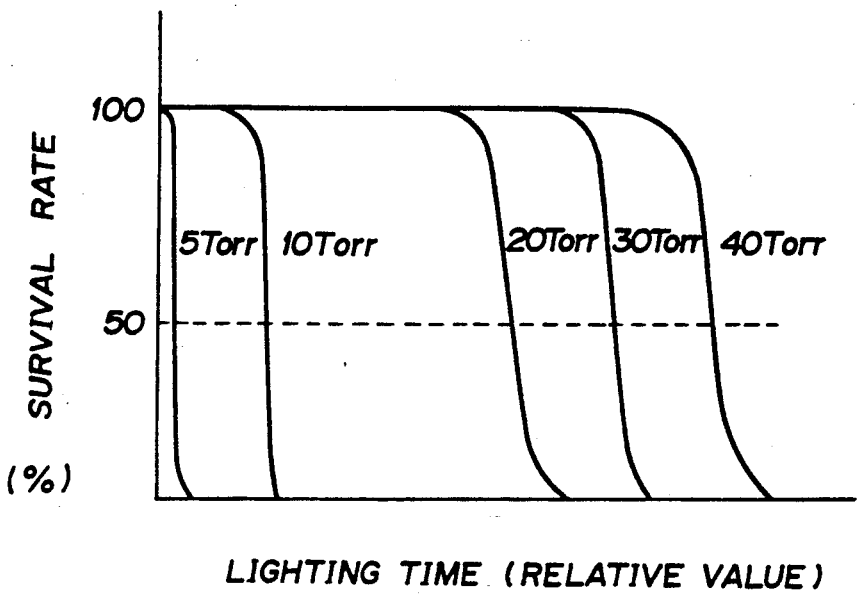
FIG. 3 is a graph which shows the relationship between the pressure of the gas filled and the lamp life.

The relationship between the electric power ($\omega_g$) required for glow discharge at starting and the lighting time (the time from the passage of electricity to the starting of arc discharge) ($\tau$) and the relationship between the quantity of energy ($\epsilon_g$) required for glow discharge and the lighting time ($\tau$) were first examined by changing the pressure p of the gas to various values while the internal diameter d of the glass tube was kept at 7 mm. The results obtained are shown in FIGS. 1 and 2. In FIG. 1, the abscissa is the relative value of $\omega_g$, and the ordinate is the value of $1/\tau$ in units of $sec^{-1}$. The four curves respectively represent the correlations between $\omega$ g and $1/\tau$ when the values of pressure p of the gas were 5 Torr, 10 Torr, 20 Torr and 40 Torr. In FIG. 2, the abscissa is the relative value of $\epsilon_g$, and the ordinate is the value of $1/\tau$ in units of $sec^{-1}$. The four curves respectively represent the correlations between $\epsilon_g$ and $1/\tau$ when the p values were 5 Torr, 10 Torr, 20 Torr and 40 Torr. As can be seen from FIGS. 1 and 2, when the pressure p of the gas charged is increased, the transition from glow discharge to arc discharge easily takes place and arc discharge does not readily reverse to glow discharge so that stable arc discharge is formed. This was also supported by life tests. The results obtained are shown in FIG. 3. In the figure, the abscissa is the relative value of the lighting time, and the ordinate is the survival rate in the unit of %. The four curves respectively represent the life characteristics when the values of the pressure p of the gas were 5 Torr, 10 Torr, 20 Torr and 40 Torr, As can be seen from FIG. 3, fluoresent lamps with a low pressure of the gas, i.e., 5 to 10 Torr, cannot maintain a stable arc and exhibit retransition to glow discharge and have a reduced lifes. The life increased as the pressure of the gas increased, and in particular, the life was several thousands hours in the case of a pressure of 40 Torr. It is thought that this is because the time taken for glow discharge and the electric power consumed by glow discharge are reduced since the more the arc discharge is stabilized, the higher the pressure of the gas, Thus, the degree of scattering and wear of the emitter are reduced and the level of early breaking of the coil is reduced. As generally said, an increase in the pressure of the gas has the effect of reducing the evaporation of the emitter. When two types of lamps respectively having internal diameters of 3 mm and 5 mm were subjected to the same tests as those described above, the same tendency was obtained. However, a slight difference was recognized depending upon the internal diameter d of the glass tube.

Figure 4:
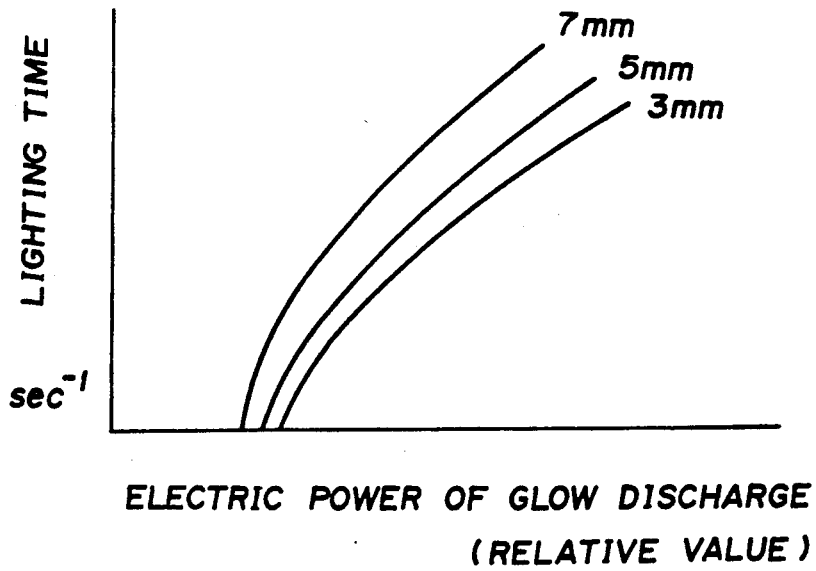
FIGS. 4 and 5 are graphs which show the relationships between the internal diameter of the tube and the starting characteristics when the pressure of the gas charged is fixed.
Figure 5:
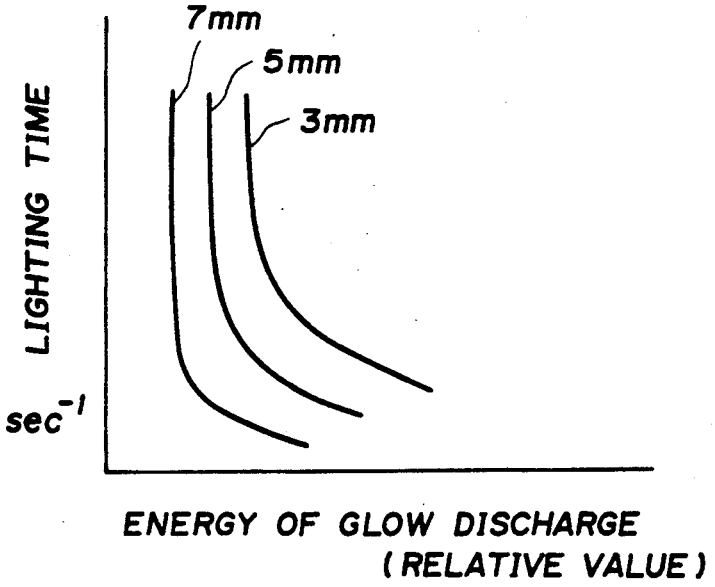
Figure 6:
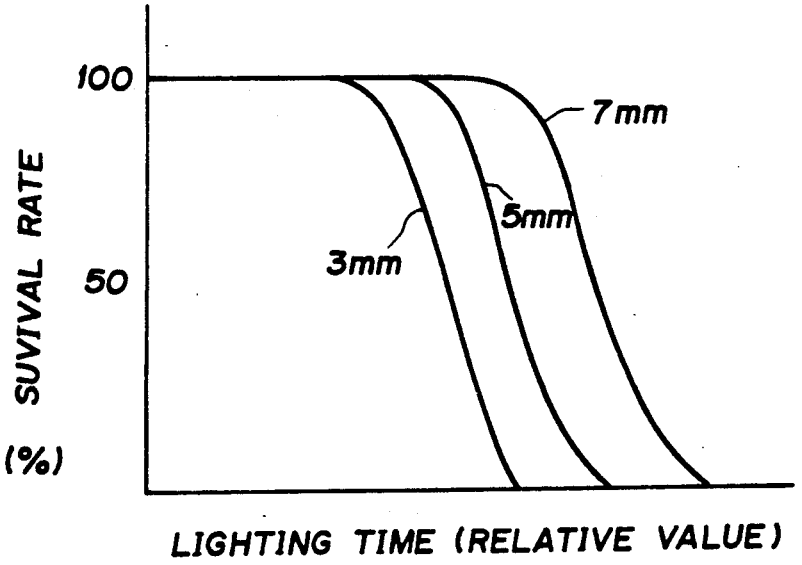
FIG. 6 is a graph which shows the relationship between the internal diameter of the tube and the lamp life.

The relationship between the electric power ($\omega_g$) required for glow discharge at starting and the lighting time ($\tau$) and the relationship between the quantity of energy ($\epsilon_g$) required for glow discharge and the lighting time ($\tau$) were then examined by changing the internal diameter of the tube to various values, while the pressure of the bas was kept at 30 Torr. The results obtained are shown in FIGS. 4 and 5. In FIG. 4, the abscissa is the relative value of $\omega_g$, and the ordinate is the value of $1/\tau$ in units of $sec^{-1}$. The three curves respectively represent the correlations between $\omega_g$ and $1/\tau$ when the internal diameter of the tube was respectively 3 mm, 5 mm and 7 mm. In FIG. 5, the abscissa is the relative value of $\epsilon_g$, and the ordinate is the value of $1/\tau$ in units of $sec^{-1}$. The three curves respectively represent the correlations between $\epsilon_g$ and $1/\tau$ when the values d were respectively 3 mm, 5 mm and 7 mm. As can be seen from FIGS. 4 and 5, when the internal diameter d of the glass tube is increased, the transition from glow discharge to arc discharge easily takes place and arc discharge does not readily reverse to glow discharge so that stable arc discharge is formed. This was also supported by life tests. The results obtained are shown in FIG. 6. In the figure, the abscissa is the relative value of the lighting time, and the ordinate is the survival rate in the unit of %. The curves respectively represent the life characteristics when the internal diameter of the glass tube was 3 mm, 5 mm and 7 mm. As can be seen from FIG. 6, the lamps with a small internal diameter of the tube exhibited short operational lifes and the life increased as the internal diameter of the tube increased, and in particular, the operational life was several thousands hours in the case 7 mm. It is thought that this is because the time taken for glow discharge and the electric power consumed by glow discharge are reduced since the more the arc discharge is stabilized, the greater the internal diameter of the tube. Thus, the degree of scattering and wear of the emitter are reduced and the level of early breaking of the coil is reduced. As generally said, an increase in the pressure of the gas has the effect of reducing the evaporation of the emitter. In the cases in which the pressure of the gas was respectively 10 Torr, 20 Torr and 40 Torr, the same results were obtained.

Figure 7:
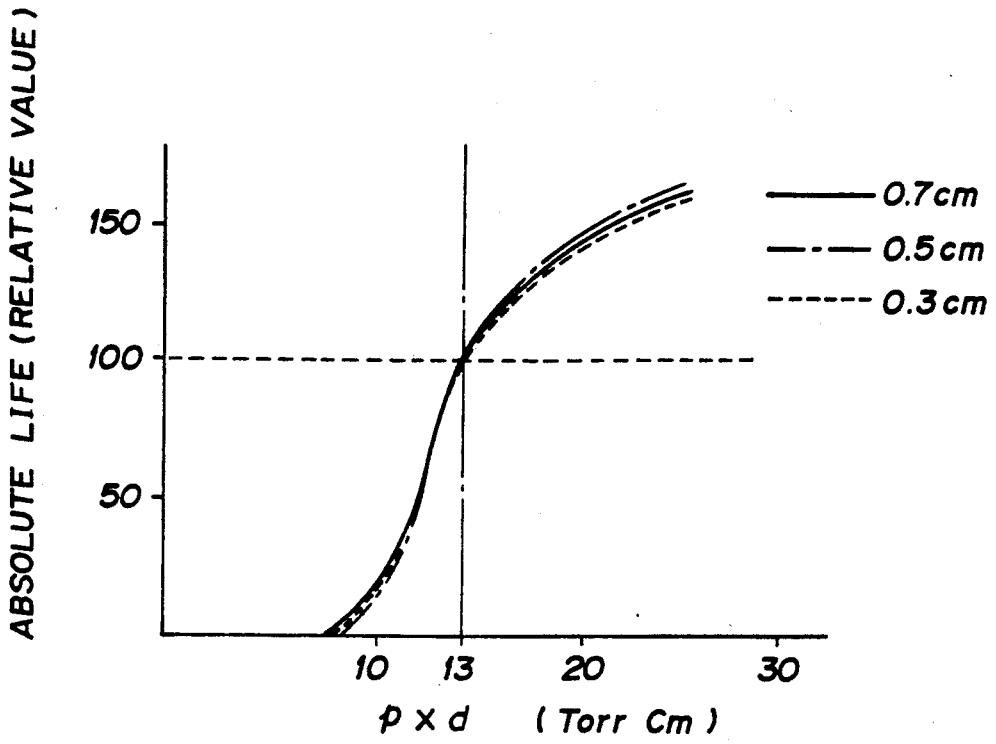
FIG. 7 is a graph which shows the effect of the product of the pressure of the gas filled and the internal diameter of the tube on the life.
Figure 8:
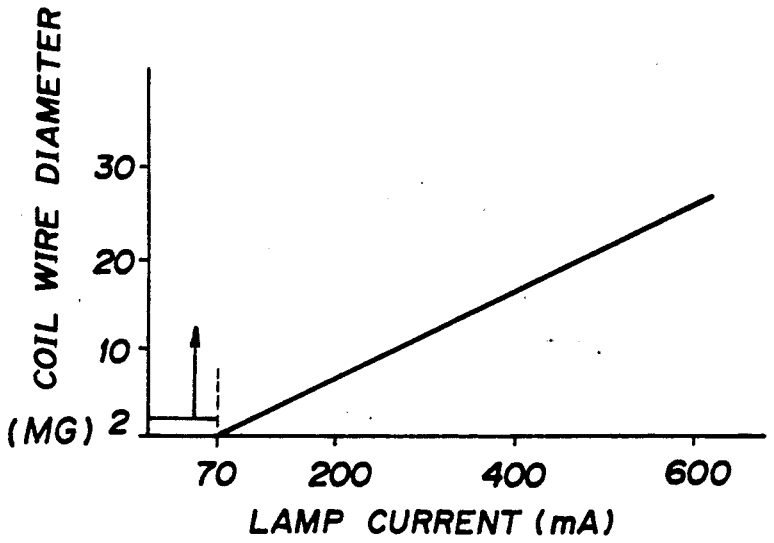
FIG. 8 is a graph which shows the relationship between the conventional design standards and the limit on the diameter of the wire of the present invention using the relationship between the lamp current and the diameter of the coil fine wire used.

It is therefore apparent from all the experimental results that an increase in the pressure of the gas inside the tube and an increase in the internal diameter of the tube equally contribute to the stabilization of arc discharge and consequently cause a reduction in blackening at the end of the tube, resulting in the achievement of a long useful operational life. It can be estimated from this matter that an increase in the pressure of the gas and an increase in the internal diameter of the tube have a synergetic effect. Thus, the inventor examined the correlation between the operational life and the product of the pressure p of the gas and the internal diameter d of the tube. The results obtained are shown in FIG. 7. In FIG. 7, the abscissa is the value of $p \times d$ in the unit of Torr.cm, and the ordinate is the relative value of the absolute life. The solid line, chain line and broken line respectively represent the correlations when the internal diameter of the tube was 0.7 cm, 0.5 cm and 0.3 cm. As can be seen from the figure, the curves in all the cases of the internal diameter have forms significantly similar to each other, and, in all the curves, the curve forms clearly change at a boundary at which $p \times d = 13$ Torr cm. It is also found that the operational life rapidly decreases in the range of $p \times d < 13$, and the operational life slowly increases in the range of $p \times d \geqq 13$. In other words, it is found that, if $p \times d \geqq 13$ is established, arc discharge is stabilized, and a long operational life is obtained. In expression using numerical values, for example, when the internal diameter of the tube is 0.7 cm, the pressure of the gas is preferably 19 Torr or more, and when the internal diameter of the tube is 0.5 cm, the pressure of the gas is preferably 26 Torr or more. In this case, if a fine wire of tungsten, having a diameter which is greater or smaller than the conventional design standards, is used as the coil wire which forms the hot cathode, the same effect as that described above is obtained regardless of the conventional design standards. FIG. 8 shows a graph of the relationship between the lamp current and the diameter of the fine wire coil in the fluorescent lamp. In the figure, the abscissa is the lamp current in the unit of mA, the ordinate is the diameter of the fine wire coil in the unit of MG, and the straight line represents the above-described design standards. As can be seen from the figure, the diameter of the coil fine wire is very small and close to zero if the lamp current is 70 mA or less. As described above, however, if the condition $p \times d \geqq 13$ Torr.cm of the present invention is established, since it is not always necessary to follow the conventional design standards, it is possible to obtain a necessary level of mechanical strength by increasing the diameter of the coil fine wire to a value greater than the design standards when the lamp current is small. It was found from experiments that, if the diameter of the fine wire coil is 2 MG or more, it is possible to obtain strength required for production of the fine wire, formation of the coil and the hot cathode, as well as increasing the length of the coil. In addition, in this case, since the temperature of the cathode luminescent point is satisfactorily high, necessary thermionic emission can be obtained so that the transition to arc discharge takes place easily and the formed arc discharge is stable, in the same manner as in the case in which the design standards are used.

As described above, in the present invention, if the lamp current is over 30 mA, the quantity of ions and electrons flowing in the hot cathode is sufficiently increased, and necessary thermionic emmision is obtained by increasing the temperature of the cathode luminescent point even if the condition of $pd \geqq 13$ Torr.cm is not established. As a result, there are obtained in easy transition to arc discharge and stabilization of arc discharge, as well as sufficient mechanical strength owing to an increase in the thickness of the fine wire coil. Thus, the present invention does not exhibit a remarkable effect. In the present invention, the lamp current is therefore limited to a value of 50 mA or less.

In addition, in the present invention, the coil which forms the hot cathode is not limited to the above-described form of a double coil, and, for example, a single coil or triple coil can be used. The coil fine wire is also not limited to the above-described tungsten wire, and a molybdenum wire, tungsten-molybdenum alloy wire or other high-melting point metal wires may be used.

As described above, the hot cathode-type fluoresent lamp, of the character described in preferred embodiments of the present invention, has the effect of improving the starting characteristics in an early state of lighting and increasing the operational life. It was also found, from practical use, that the lamp is not completely satisfactory as a back light required to have an operational life of about several thousands hours. For example, if argon at p=20 Torr is filled in a tubular envelope lamp having an internal diameter d=6.5 mm, where pd =13, which satisfies the above-described condition, and this lamp is lighted with a lamp current of 15 mA, an average life of 2000 hours or more could be obtained. However, if the lamp is lighted with a lamp current of 10 mA, blackening sometime occurs after about 1000 hours has passed. It is thought that this is because the surface of the emitter is stained with the passage of time, the work function is increased, and transition from glow discharge to arc discharge or the maintenance of stable arc discharge is difficult, though in an early stage of lighting, transition from glow discharge to arc discharge easily takes place and the arc is stably maintained because of a good state of the emitter and a low work function.

Taking the above fact into consideration, the inventor of the present invention paid attention to the relationship between the hot cathode's ability to emit thermoelectrons and the cathode's fall voltage in the course of investigations on the mechanism of the hot cathode. In other words, since it can be thought that a normal hot cathode is in a state which allows thermoelectrons to be sufficiently emitted therefrom regardless of design parameters of lamps (the lamp current, pressure of gas filled, diameter of the filament fine wire and so on), this is directly reflected in the cathode fall voltage. According to lecture No. 20 at the IES meeting in 1988, the characteristics of the cathode fall portion of a fluorescent lamp can be approximated by using the following equations:

$$I_L = I_i + I_e \ldots \quad (1)$$

$$I_e = I_{th} + \gamma I_i \ldots \quad (2)$$

$$I_i = C(V_K - V_i) I_e \ldots \quad (3)$$

wherein $I_L$: lamp current, $I_i$: ion current
$I_e$: electron current, $I_{th}$: thermionic current
$\gamma$: coefficient of electron emission of electrode
$V_k$: cathode fall voltage
$V_i$: ionization potential of ionized gas
C: constant determined by the type of gas used When the relationships between the cathode descent voltage $V_K$ and $I_{th}/I_L$ is determined from the above-described equations (1), (2) and (3), the following equation is obtained:

$$V_k = V_i + \frac{1}{C} \cdot \frac{I - I_{th}/I_L}{\gamma + I_{th}/I_L} \quad (4)$$

Figure 9:
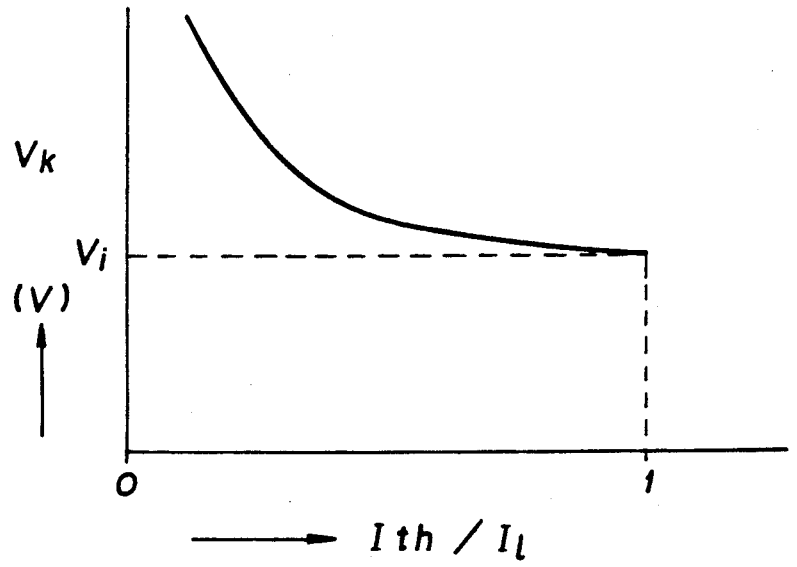
FIG. 9 is a graph which shows the relationship between $I_{th}/I_L$ and $V_K$.

This equation (4) is illustrated in FIG. 9 wherein the abscissa is the value of $I_{th}/I_L$, and the ordinate is the $V_K$ value. It is found from FIG. 9 that, when thermoelectrons are sufficiently emitted from the cathode and the value of $I_{th}/I_L$ is close to 1, $V_K$ is close to $V_i$. However, when thermoelectrons are not sufficiently emitted from the cathode and the value of $I_{th}/I_L$ is small, $V_K$ is increased. That is, the cathode's ability to emit thermoelectrons can be estimated from the value of $V_K$, and an appropriate hot cathode can be designed by causing the $V_K$ value to correspond to the life test.

Figure 10:
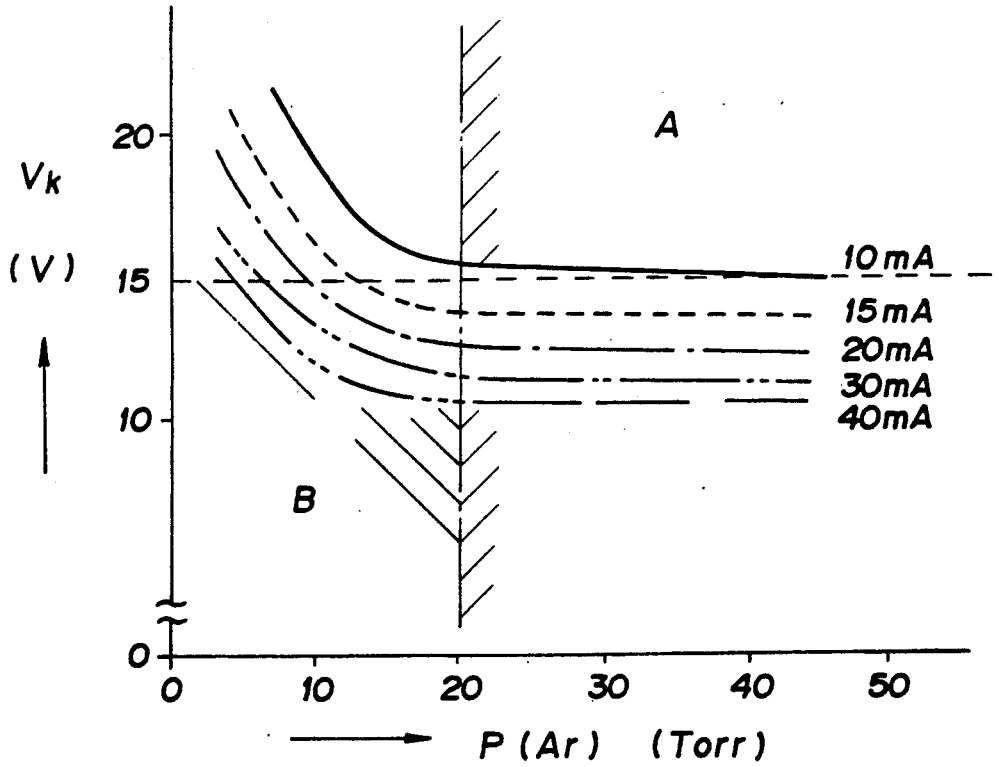
FIG. 10 is a graph which shows the relationship between P and $V_K$.
Figure 11:
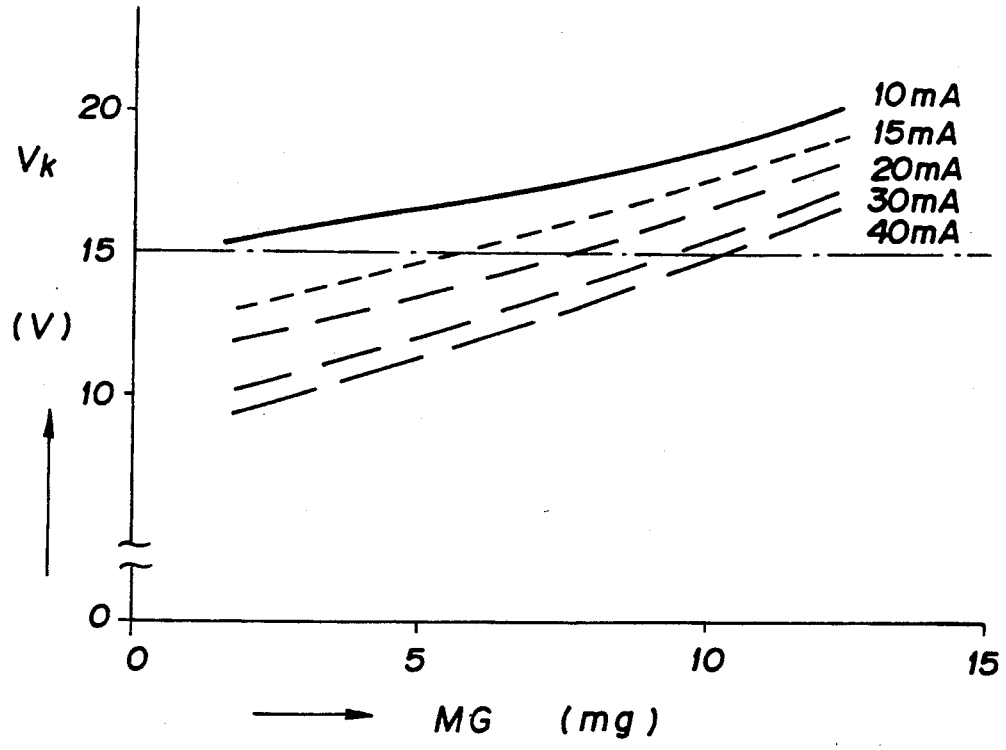
FIG. 11 is a graph which shows the relationship between MG and $V_K$.

From the above-described viewpoint, the inventor examined the relationship between the design parameters of lamps and $V_K$. The results obtained are shown in FIGS. 10 and 11. FIG. 10 shows the results of measurements of the cathode fall voltage $V_K$ which were performed by using a lamp tube with an internal diameter of 0.65 cm in which argon was provided at various values of pressure p and which was lighted with a direct current using various lamp currents $I_L$. The abscissa is the p value in the unit of Torr, and the ordinate is the $V_K$ value in the unit of V. The solid line, broken line, one-dot chain line and two-dot chain line respectively represent the $V_K$ characteristics at $I_L = 10$ mA, 15 mA, 20 mA and 30 mA. FIG. 3 shows the results of measurements of the cathode fall voltage $V_K$ which were performed by using a lamp tube with a internal diameter of 0.65 cm and a changing MG (the weight in terms of mg relative to a length of the fine wire of 200 mm) of the coil filament fine wire), with the lamp being lighted with a direct current using various lamp currents $I_L$. The abscissa is the MG value in units of mg, and the ordinate is the $V_K$ value in the unit of V. The solid line, broken line, one-dot chain line, two-dot chain line and three-dot chain line respectively represent the $V_K$ characteristics at $I_L = 10$ mA, 15 mA, 20 mA, 30 mA and 40 mA. As can be seen from FIGS. 10 and 11, maintenance of the $V_K$ value at a low level requires the following matters:

(1) The pressure of the gas is increased (region A at pressure of 20 Torr or higher).

(2) The MG value of the coil filament fine wire is reduced.

(3) Since the $V_K$ value tends to rapidly increase from a certain value of lamp current at a boundary, it is considered that the hot cathode does not satisfactorily operate within this region.

In this way, the relationships between the design parameters of lamps and the $V_K$ value were clarified.

The relationship between the life and $V_K$ was then examined. The specification of the lamp used in the experiments are shown in the table give below.

0.3 to 0.5 mg of emitter was deposited on each of the coils used. Life tests were performed by continuously lighting on and off in a cycle comprising turning the lamp on for 90 minutes and lighting off for 10 minutes at room temperature. The results obtained are shown in the table given below.

TABLE

| Experiment No. | 1 | 2 | 3 | 4 | 5 | 6 | 7 | 8 | 9 | 10 |
|---|---|---|---|---|---|---|---|---|---|---|
| Example Group | ○ | X | X | X | X | X | X | ○ | ○ | ○ |
| Specification | | | | | | | | | | |
| Mg (mg) | 3.7 | 3.7 | 3.7 | 6.7 | 6.7 | 3.7 | 6.7 | 3.7 | 6.7 | 3.7 |
| p (Ar) (Torr) | 10 | 20 | 40 | 20 | 40 | 20 | 40 | 10 | 10 | 2 |
| d (cm) | 0.65 | 0.65 | 0.65 | 0.65 | 0.65 | 0.65 | 0.45 | 0.65 | 0.45 | 0.65 |
| $I_L$ (mA) | 12 | 10 | 12 | 10 | 12 | 15 | 30 | 20 | 30 | 40 |
| Condition | | | | | | | | | | |
| $V_k$ (V) | 18 | 15.5 | 14.5 | 16 | 15.5 | 14 | 12 | 14.5 | 13.5 | 15 |
| pd (Torr cm) | 6.5 | 13 | 26 | 13 | 26 | 13 | 18 | 6.5 | 4.5 | 1.3 |
| Judgement | | | | | | | | | | |
| Life ≧ 2000 Hrs | NO | NO | YES | NO | NO | YES | YES | YES | YES | NO |
| pd ≧ 13 | NO | YES | YES | YES | YES | NO | YES | NO | NO | NO |
| $V_k < 15$ | NO | NO | YES | NO | NO | YES | YES | YES | YES | YES |
| $(V_k - 10)$ pd ≧ 7 | YES | — | — | — | — | YES | — | YES | YES | NO |

Note:
The group of pd ≧ 13 was denoted by a mark X.
The group of pd < 13 was denoted by a mark ○.

Figure 12:
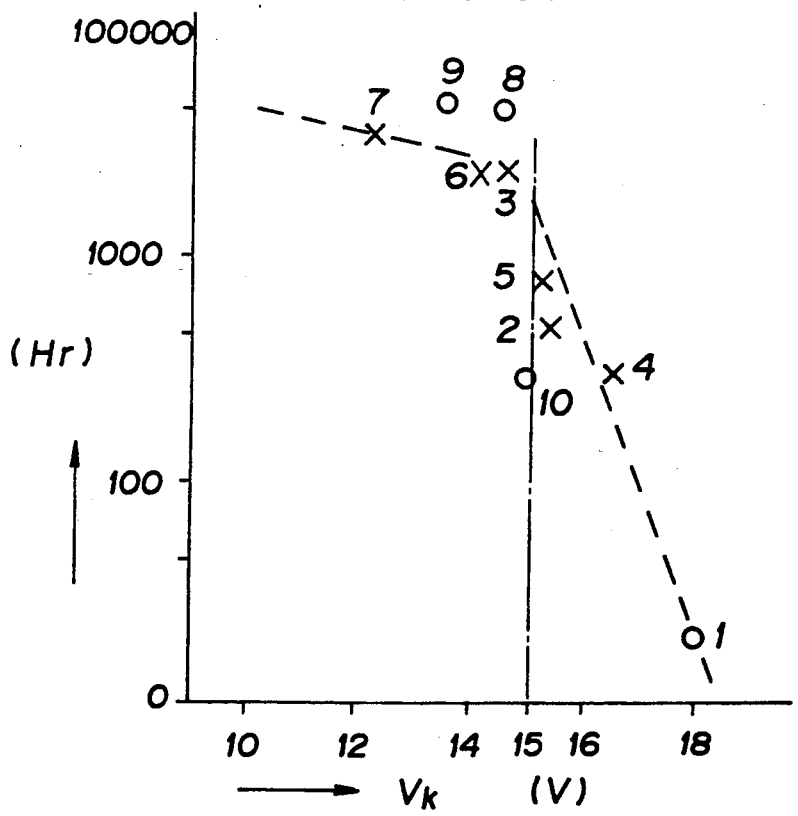
FIG. 12 is a graph which shows the relationship between $V_K$ and the lighting time with respect to lamps having various types of specification.

The results given in the table are shown in FIG. 12. In FIG. 12, the abscissa is the $V_K$ value in the unit of V, and the ordinate is the life in the unit of Hr. Each mark x represents the group denoted by x, each mark ○ represents the group denoted by ○, and the numerals denotes the experiment numbers. It was found from the above table and FIG. 12 that the lamps (Nos. 2, 4 and 5) in which pd≧13 Torr.cm but $V_K > 15$ V showed blackening on the tube wall near the electrode and glow discharge before 1000 hours had passed. When each of the lamps (Nos. 2, 4, 5) was thus broken into and examined with respect to the state of the electrodes, a sufficient amount of emitter remained, while the surface of the emitter was significantly blackened. When the cause of the blackening of the emitter was examined, it was thought that although the emitter had a good surface state and exhibited good emission and easy transition from glow discharge to arc discharge in a early stage of lighting, the sealed metal members such as an internal lead wire, filament leg portion and so forth which are electrically connected to the electrode relatively easily produce discharge because the cathode descent voltage $V_K$ is large. Thus, nickel or tungsten is deposited on the emitter surface by sputtering produced owing to the impact of electrons and ions. The stain of the surface of the emitter increases as the time of lighting increases, and the emission ability deteriorates owing to an increase in the work function, causing a reduction in the operational life owing to acceleration of sputtering.

On the other hand, each of the lamps (Nos. 3, 7) in which pd≧13 Torr.cm and $V_K \leqq 15$ V, exhibited an operational life of 2000 hours or more. It is thought that this is because no discharge takes place in the sealed metal members which were electrically connected to the electrode, and thus no sputtering occurs. The long life is also caused by the condition of pd≧13 Torr.cm which causes the temperature of the cathode luminescent point of the electrode to be kept at a sufficiently high value and thus improves the emission ability and starting characteristics even if the lamp is lighted with a small current $I_L$ of 50 mA or less.

As a result of comparison between the above table and FIG. 10, the inventor also found on the basis of the experiments that there is a range which enables the achievement of the object of the present invention to obtain a life of several thousands hours even if pd<13 Torr.cm. This range is a portion of $I_L \leqq 50$ mA in the region B (the fourth quadrant) shown in FIG. 10. This region is expressed mathematically by following numeral expressions:

$$pd < 13$$

$$V_K \leqq 15 \text{ (V) and}$$

$$(V_K - 10)pd \geqq 7$$

As seen from the experimental examples (Nos. 6, 8, 9) each denoted by the mark ○ in the table and FIG. 12, a long life of 2000 hours or more could be obtained within the range which satisfies the above-described conditions.

The present invention can be applied to all fluorescent lamps which are operated with a small current of 50 mA or less regardless of the shape of the valve of the relevant fluorescent lamp and the use thereof.

With the described embodiments, the disclosure was made with respect to the fluorescent lamp having a glass tube circular in cross section having an inner diameter d, but the present invention may be applicable to a fluorescent lamp having another shape of cross section. In such modification, the modification will be considered to have a characteristic diffusion length equivalent to that of the circular glass tube of a fluoresent lamp having an inner diameter d.

What is claimed is:

1. A fluorescent lamp of a hot cathode type which is operated with a lamp current of 50 mA or less, comprising:

an outer tube forming an envelop having an inner diameter of d cm;

a gas provided in said outer tube for sustaining an electric discharge therein, said gas having a pressure of p Torr; and a pair of electrodes disposed at both ends of said outer tube in an opposing fashion, at least one of said pair of electrodes being operated in a hot cathode mode in which an associated cathode fall voltage has a value of $V_K$;

wherein the following relationships are established between said inner diameter d cm, said pressure p Torr and said cathode fall voltage $V_K$:

$$p.d \geqq 13 \text{ and } V_K < 15.$$

2. A fluorescent lamp according to claim 1, wherein a coil across said at least one pair of electrodes operating in the hot cathode mode is formed of a fine wire having a weight to length ratio of 2 MG (mg/200 mm) or more, where MG is a weight in terms of mg relative to a length of a fine tungsten wire of 200 mm.

3. A fluorescent lamp according to claim 1, wherein said gas is a rare gas essentially consisting of Argon gas.

4. A fluorescent lamp of a hot cathode type which is operated with a lamp current of 50 Ma or less comprising:

an outer tube forming an envelope having an inner diameter of d cm;

a gas provided in said outer tube for sustaining an electric discharge therein, said gas having a pressure of p Torr;

a pair of electrodes disposed at both ends of said outer tube in an opposing fashion, at least one of said pair of electrodes being operated in a hot cathode mode in which an associated cathode fall voltage has a value of $V_K$;

wherein the following relationships are established between said inner diameter d cm, said pressure P Torr and said cathode fall voltage $V_K$:

$$p.d \geqq 13 \text{ and } V_K < 15; \text{ and}$$

a coil across said at least one of said pair of electrodes operating in the hot cathode mode, said coil being formed of a fine wire having a weight to length ratio of 2 MG (mg/200 mm) or more, where MG is a weight in terms of mg relative to a length of a fine tungsten wire of 200 mm.

* * * * *